US011220811B2

(12) United States Patent
Hong et al.

(10) Patent No.: US 11,220,811 B2
(45) Date of Patent: Jan. 11, 2022

(54) INTEGRATED HEIGHT ADJUSTING WASHSTAND DEVICE

(71) Applicant: UD SYSTEM CO., LTD, Gunpo-si (KR)

(72) Inventors: Soon Jin Hong, Uiwang-si (KR); Kwang Bok Woo, Seoul (KR)

(73) Assignee: UD SYSTEM CO., LTD, Gunpo-si (KR)

( * ) Notice: Subject to any disclaimer, the term of this patent is extended or adjusted under 35 U.S.C. 154(b) by 37 days.

(21) Appl. No.: 16/645,488

(22) PCT Filed: Apr. 18, 2019

(86) PCT No.: PCT/KR2019/004722
§ 371 (c)(1),
(2) Date: Mar. 8, 2020

(87) PCT Pub. No.: WO2020/105816
PCT Pub. Date: May 28, 2020

(65) Prior Publication Data

US 2021/0222413 A1 Jul. 22, 2021

(51) Int. Cl.
*E03C 1/328* (2006.01)
*E03C 1/04* (2006.01)

(52) U.S. Cl.
CPC ..... *E03C 1/328* (2013.01); *E03C 1/04* (2013.01)

(58) Field of Classification Search
CPC ..... E03D 11/125; E03C 2001/0415; E03C 1/066; E03C 1/324; E03C 1/328
See application file for complete search history.

(56) References Cited

U.S. PATENT DOCUMENTS 7,111,337 B2 * 9/2006 Hong ..... E03C 1/328 254/93 R
8,991,425 B2 * 3/2015 DeVries ..... E03C 1/04 137/625.4

FOREIGN PATENT DOCUMENTS

JP 2002-345661 A 12/2002
JP 3839275 B2 * 11/2006
(Continued)

OTHER PUBLICATIONS

Machine translation of JP3839275-B2 retrieved from ip.com on Jun. 8, 2021 (Year: 2021).*

*Primary Examiner* — Janie M Loeppke
(74) *Attorney, Agent, or Firm* — Revolution IP, PLLC

(57) ABSTRACT

The present invention relates to an integrated height adjusting washstand device, the integrated height adjusting washstand device according to an embodiment of the present invention includes: a water faucet located at an upper center of a washstand and supplying cold water and hot water while selectively adjusting a usage amount thereof by a user's operation; a height adjusting part disposed at an lower portion of the washstand and adjusting a height while receiving the cold water from the water faucet and raising or lowering the washstand by the user's operation; a height adjusting operation part disposed at one side surface of the water faucet and connected to the water faucet and the height adjusting part, respectively, and operating so as to control the height by adjusting a supply amount and a direction of the cold water supplied from the water faucet to the height adjusting part by the user's operation; and an operation shut-off part disposed inside the water faucet and installed at a supply position of the cold water supplied from the water faucet to the height adjusting operation part, and provided so as to suppress the height adjusting operation by shutting off
(Continued)

the cold water supplied to the height adjusting operation part when the cold water in the water faucet is used.

4 Claims, 7 Drawing Sheets

(56) References Cited

FOREIGN PATENT DOCUMENTS

| | | | |
|---|---|---|---|
| KR | 10-2002-0028944 | A | 4/2002 |
| KR | 10-2008-0100532 | A | 11/2008 |

* cited by examiner

INTEGRATED HEIGHT ADJUSTING WASHSTAND DEVICE

TECHNICAL FIELD

The present invention relates to an integrated height adjusting washstand device, and more particularly, to an integrated height adjusting washstand device capable of adjusting water supply and height adjustment within a range operated by a user to improve convenience in use, while increasing safety by improving a structure so that a means of adjusting a height of a washstand is integrated with a water supply device, and shutting off a height adjusting operation at the time of water supply in cooperation with water supply and height adjustment.

BACKGROUND ART

In general, a washstand using tap water is installed for use in washrooms such as household toilets, public toilets, and various shower facilities, etc. The washstand that is fixedly installed with a predetermined height are universalized. Since such a height-fixed washstand is fixed to a wall at a limited height with respect to adults, there was a problem that it is inconvenient to use such a general adult height washstand for people who are taller or smaller than the installation height thereof, especially for children.

Accordingly, various types of technologies for adjusting the height of the washstand are developed and used.

As a conventional washstand height adjusting device, a device that installs an electric motor to the washstand to move up and down by a user's operation was used.

However, since the washstand is installed inside a bathroom and moisture remains in the surroundings, and a risk of electric shock is increased when using electric power, there was a problem that a cost is increased to improve waterproof performance.

Accordingly, in recent years, a height adjusting device has been developed and used in which a height is adjusted by an operation of a user in a cylinder method using a pressure of cold water supplied to a water faucet.

However, since a conventional height adjusting device should be installed separately on one side of the water faucet of the washstand, an installation space is required for separate installation on the washstand, and it is difficult to install with the existing washstand, so that a dedicated washstand should be manufactured and constructed separately, and accordingly, there was a problem that a cost is increased.

In addition, since the conventional height adjusting device shares the cold water with the water faucet, when the height is adjusted while using cold water in the water faucet, an amount of cold water used is reduced, and when cold water usage is stopped in a state in which the height adjustment is not operated immediately, the height adjustment is operated suddenly, and there is a problem that a risk of injury is increased due to a movement of the washstand which a user may not expect.

Objects of the present invention are not limited to the above-mentioned objects, and other objects not mentioned may be clearly understood from the following descriptions belong.

Technical Problem

The present invention has been devised to solve the above-described problems, and the present invention is directed to providing an integrated height adjusting washstand device capable of adjusting water supply and height adjustment within a range operated by a user while increasing safety, and improving convenience of use by improving a structure so that a means of adjusting a height of a washstand is integrated with a water supply device, and shutting off a height adjusting operation at the time of water supply in cooperation with water supply and height adjustment.

Technical Solution

In order to achieve the above object, an integrated height adjusting washstand device according to an embodiment of the present invention includes: a water faucet located at an upper center of a washstand and supplying cold water and hot water while selectively adjusting a usage amount thereof by a user's operation; a height adjusting part disposed at an lower portion of the washstand and adjusting a height while receiving the cold water from the water faucet and raising or lowering the washstand by the user's operation; a height adjusting operation part disposed at one side surface of the water faucet and connected to the water faucet and the height adjusting part, respectively, and operating so as to control the height by adjusting a supply amount and a direction of the cold water supplied from the water faucet to the height adjusting part by the user's operation; and an operation shut-off part disposed inside the water faucet and installed at a supply position of the cold water supplied from the water faucet to the height adjusting operation part, and provided so as to suppress the height adjusting operation by shutting off the cold water supplied to the height adjusting operation part when the cold water in the water faucet is used.

In addition, the water faucet may include: a water faucet body fixedly disposed inward from the upper center of the washstand, having a portion in which cold and hot water is supplied located therein, and provided such that the height adjusting operation part and the operation shut-off part are installed at one side surface thereof; a hot water supply pipe disposed inward at a lower portion of the water faucet body, and provided in a pipe shape for supplying hot water supplied from an outside; a cold water supply pipe disposed inward at the lower portion of the water faucet body, and provided in a pipe shape for supplying cold water supplied from the outside; a water supply control lever disposed at an upper portion of the water faucet body, and selectively controlling a water supply of cold water and hot water by the user's operation; a water supply controller disposed inside the water faucet body, communicating with the water supply control lever therein and having a water supply control space to which the cold water supply pipe and the hot water supply pipe are connected, respectively; a water supply control plate disposed inside the water supply controller, installed to be interlocked with the water supply control lever, and provided in a plate shape having a plurality of through-holes so as to control whether or not to supply the cold water supplied from the cold water supply pipe and the hot water supplied from the hot water supply pipe by the user's operation and a water supply amount; and a water supply part disposed to protrude from a front surface of the water faucet body, communicated with the water supply control space, and supplying the cold and hot water controlled by an operation of the water supply control lever.

In addition, the height adjusting part may include: an adjusting cylinder disposed at the lower portion of the washstand, wherein a piston which is operated up and down by a fluid supplied from the lower portion of the washstand is fixedly installed to a ground from the inside so that the washstand is moved vertically depending on a supply position of the height adjusting operation part; a lowering port disposed at a lower portion of the adjusting cylinder, and when cold water is supplied by an operation of the height adjusting operation part, the cold water is supplied in a downward direction of the piston in the adjusting cylinder and the lowering port is provided to connect to the height adjusting operation part so as to lower the washstand; and a raising port disposed at an upper portion of the adjusting cylinder, and when cold water is supplied by an operation of the height adjusting operation part, the cold water is supplied in an upward direction of the piston in the adjusting cylinder, and the raising port is provided to connect to the height adjusting operation part so as to raise the washstand.

Further, the height adjusting operation may include: an operation body disposed to protrude from one side surface of the water faucet, and installed so as to communicate with a position to which the cold water of the water faucet is supplied; an operation lever disposed at an upper portion of the operation body, and selectively controlling a vertical operation of the height adjusting part by the user's operation; a supply pipe disposed inside the operation body, connected to the cold water supply portion of the water faucet to supply cold water for operating the height adjusting part, but installed with the operation shut-off part therein to shut off the supply of the cold water when the cold water is supplied from the water faucet; a raising operation pipe disposed inside the operation body, and connecting the cold water supplied to the supply pipe to a position in which the height adjusting part is raised by the user's operation of the operation lever; a lowering operation pipe disposed inside the operation body and connecting the cold water supplied to the supply pipe to a position in which the height adjusting part is lowered by the user's operation of the operation lever; an operation control part disposed inside the operation body and having an operation control space connected to the supply pipe, the raising operation pipe, and the lowering operation pipe, respectively while communicating with the operation lever therein; an operation control plate disposed inside the operation control part, installed in the operation control space to be interlocked with the operation lever, and provided in a plate shape having a plurality of through-holes for selectively controlling whether or not to supply the cold water supplied from the supply pipe to the raising operation pipe during a raising operation and to supply the cold water to the lowering operation pipe during a lowering operation by the user's operation and an water supply amount; and a drain pipe disposed outward from one side of the operation control part, and connected to the operation control space to drain the cold water supplied to the supply pipe to the outside when a height adjust operation is stopped.

Furthermore, the operation shut-off part may include: a shut-off body disposed inside the height adjusting operation part, having a shut-off space therein that is a space through which the cold water supplied to the height adjusting part passes by being installed in a portion in which the cold water of the water faucet is supplied to the height adjusting part, and formed with a shut-off inclined portion that is inclined such that a cross-sectional area of a flow path is reduced to a supply side of the water faucet of the shut-off space; a shut-off valve part disposed inside the shut-off body, provided so as to open and close the flow path through which the cold water of the water faucet passes while moving inside the shut-off space, and formed with a valve inclined portion having a slope in contact with the shut-off inclined portion in a direction of the water faucet; and a valve elastic part disposed inside the shut-off body, provided such that the shut-off valve part is elastically supported in the shut-off body, and provided in a spring shape that provides an elastic power that is opened such that the cold water is supplied to the height adjusting part through the shut-off body when the water supply of the cold water of the water faucet is stopped in a state in which the shut-off space is closed by an elastic force.

Specific matters for achieving the above object will become apparent by referring to the embodiments described in detail below with reference to the accompanying drawings.

However, the present invention is not limited to the embodiments disclosed below, but may be configured in various forms different from each other, and the present embodiments are provided so as to become complete the disclosure of the present invention and to completely inform those skilled in the art the scope of the present invention.

Advantageous Effects

According to any one of the above-described technical solutions of the present invention, an integrated height adjusting washstand device according to an embodiment of the present invention provides an effect capable of adjusting water supply and height adjustment within a range operated by a user to improve convenience in use, while increasing safety by improving a structure so that a means of adjusting a height of a washstand is integrated with a water supply device, and shutting off a height adjusting operation at the time of water supply in cooperation with water supply and height adjustment.

In addition, since the integrated height adjusting washstand device according to the embodiment of the present invention includes a faucet means for adjusting water supply and a means for height adjustment integrally, it may be installed on a mounting portion of the faucet of the existing washstand, thereby reducing costs and improving ease of installation.

DESCRIPTION OF DRAWING PORTIONS

Figure 1:
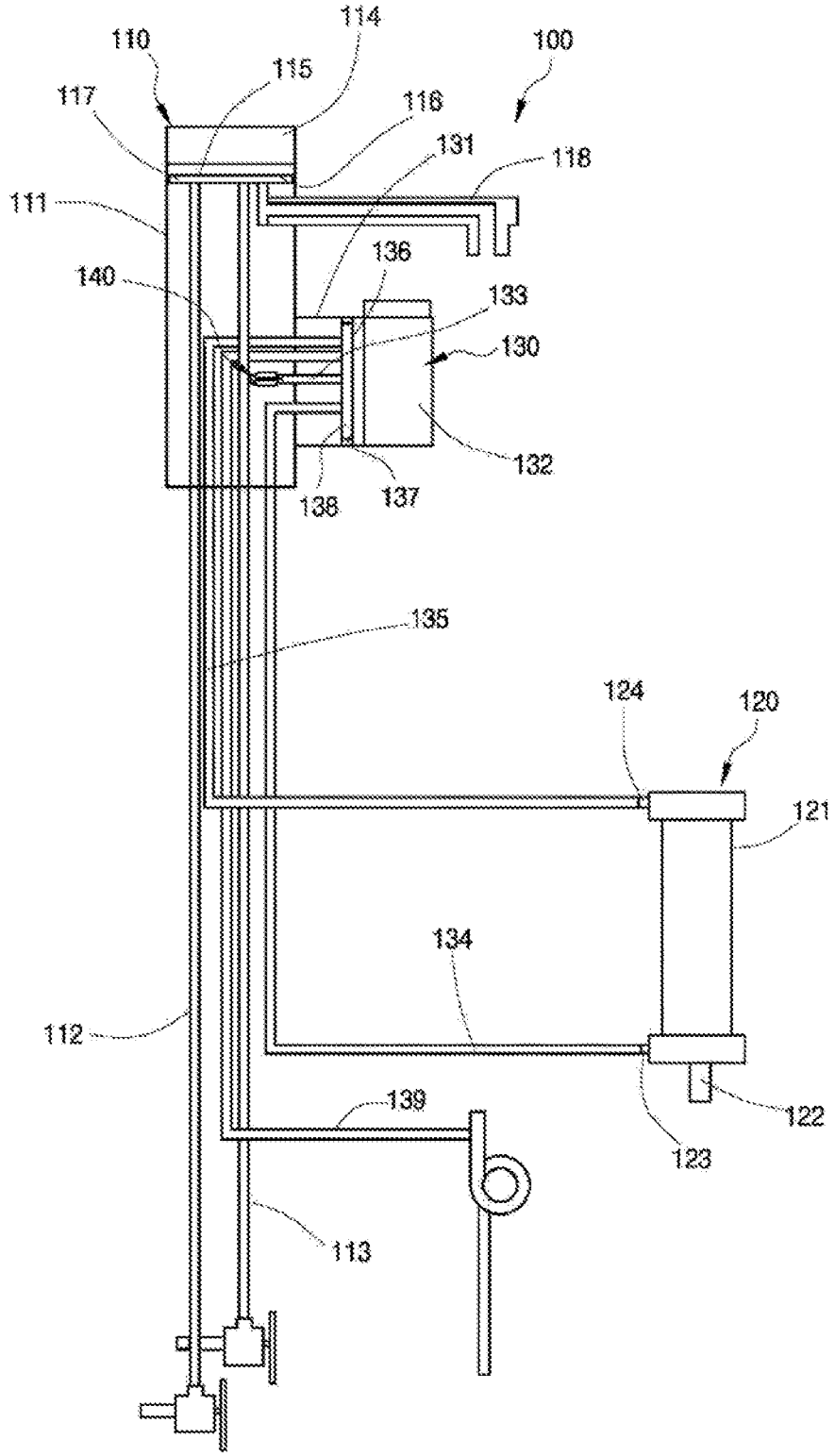
FIG. 1 is a configuration diagram illustrating an integrated height adjusting washstand device according to an embodiment of the present invention.

| <Reference numerals> | |
|---|---|
| 100: washstand device | 110: water faucet |
| 111: water faucet body 111 | 112: hot water supply pipe |
| 113: cold water supply pipe | 114: water supply control lever |
| 115: water supply controller | 116: water supply control space |
| 117: water supply control plate | 118: water supply part |
| 120: height adjusting part | 121: adjusting cylinder |
| 122: piston | 123: raising port |
| 124: lowering port | 130: height adjusting operation part 130 |
| 131: operation body | 132: operation lever |
| 133: supply pipe | 134: raising operation pipe |
| 135: lowering operation pipe | 136: operation control part |
| 137: operation control space | 138: operation control plate |
| 139: drain pipe | 140: operation shut-off part |
| 141: shut-off body | 142: shut-off space |
| 143: shut-off inclined portion | 144: shut-off valve part |
| 145: valve inclined portion | 146: valve elastic part 146. |

MODES OF THE INVENTION

While the invention can be modified in various ways and take on various alternative forms, specific embodiments thereof are shown in the drawings and described in detail below as examples. There is no intent to limit the invention to the particular forms disclosed. On the contrary, the invention is to cover all modifications, equivalents, and alternatives falling within the spirit and scope of the appended claims.

In description of the invention, when it is determined that detailed descriptions of related well-known technology may unnecessarily obscure the gist of the invention, detailed descriptions thereof will be omitted. The numbers (for example, first, and second) used in description of the specification are used only to distinguish one element from another.

In the specification, it will be understood that when an element is referred to as being "connected" or "coupled" to another element, it can be directly connected or coupled to the other element or intervening elements may be present unless the context clearly indicates otherwise.

The component suffixes "module" and "part" used in the following description are given or mixed together only considering the ease of creating the specification, and have no meanings or roles that are distinguished from each other by themselves. In addition, parts irrelevant to description are omitted in the drawings in order to clearly explain the present invention, and in the drawings, the width, length, thickness, and the like of components may be exaggerated for convenience. Throughout the specification, the same reference numerals indicate the same components.

Hereinafter, specific contents for implementing the present invention will be described with reference to the accompanying drawings.

Figure 2:
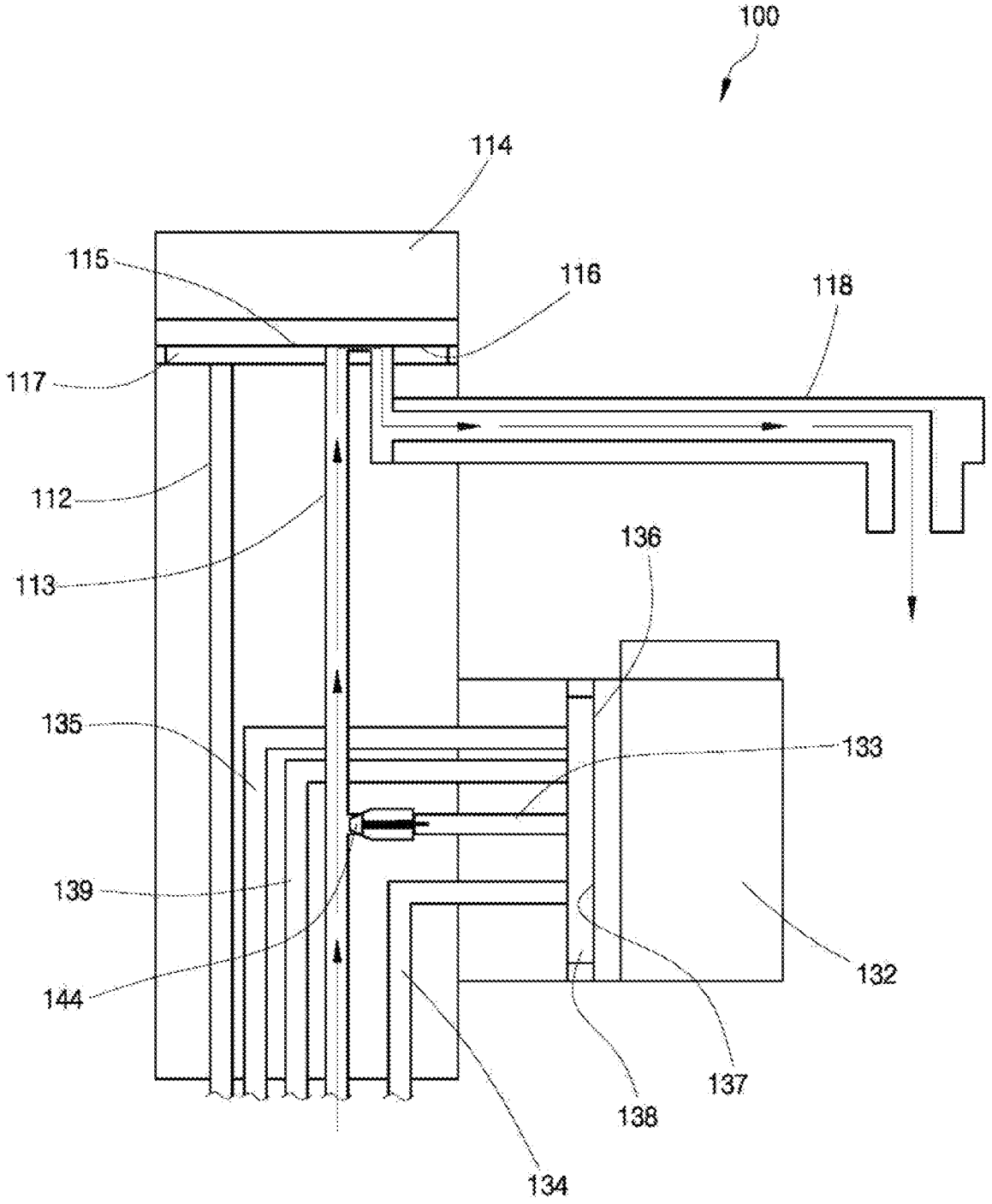
FIG. 2 is a use state diagram illustrating a state in which cold water is supplied by an operation of a water faucet of the integrated height adjusting washstand device of FIG. 1.
Figure 3:
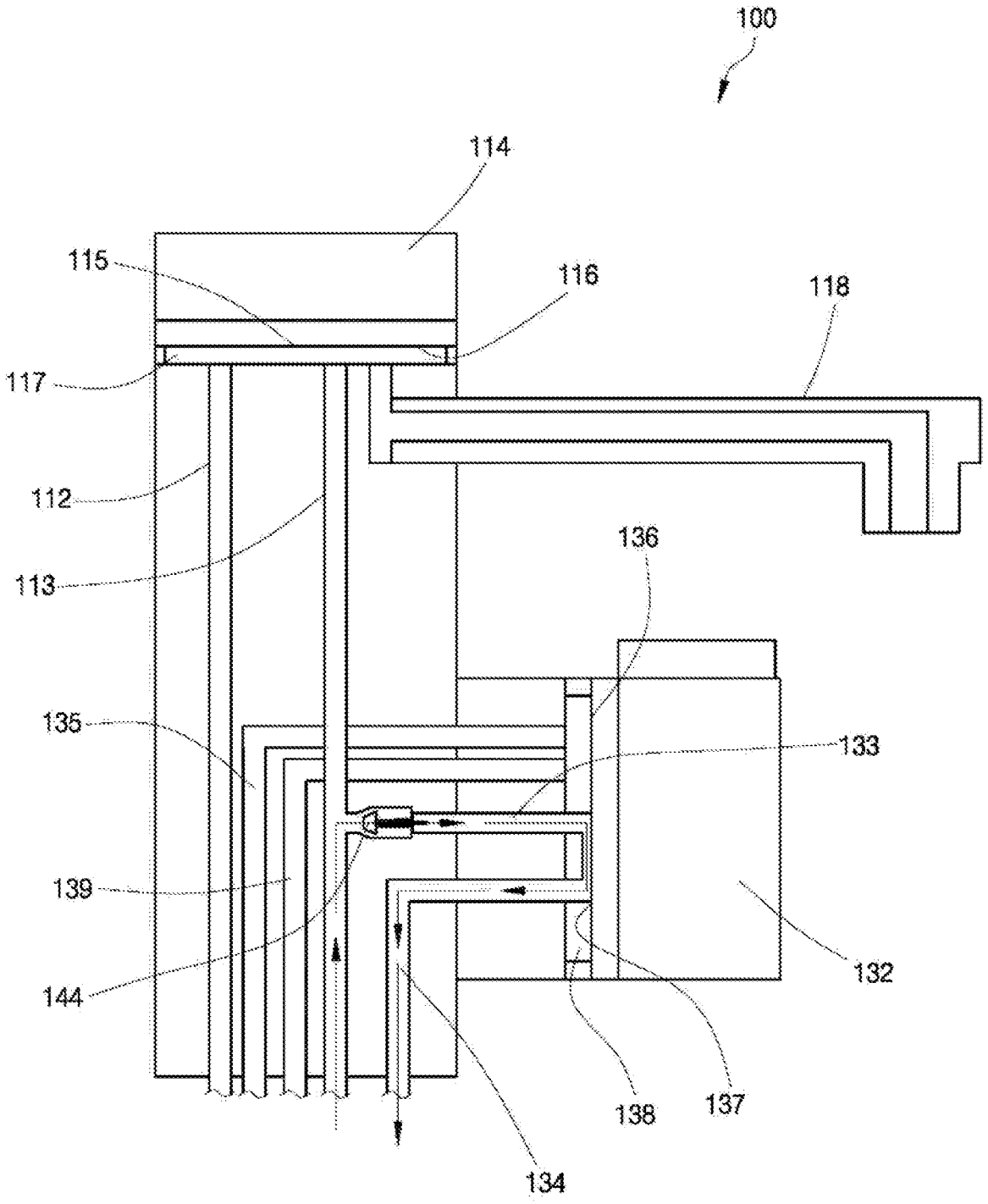
FIG. 3 is a use state diagram illustrating a state in which a washstand is raised in a state in which the water faucet of the integrated height adjusting washstand device of FIG. 1 is stopped.
Figure 4:
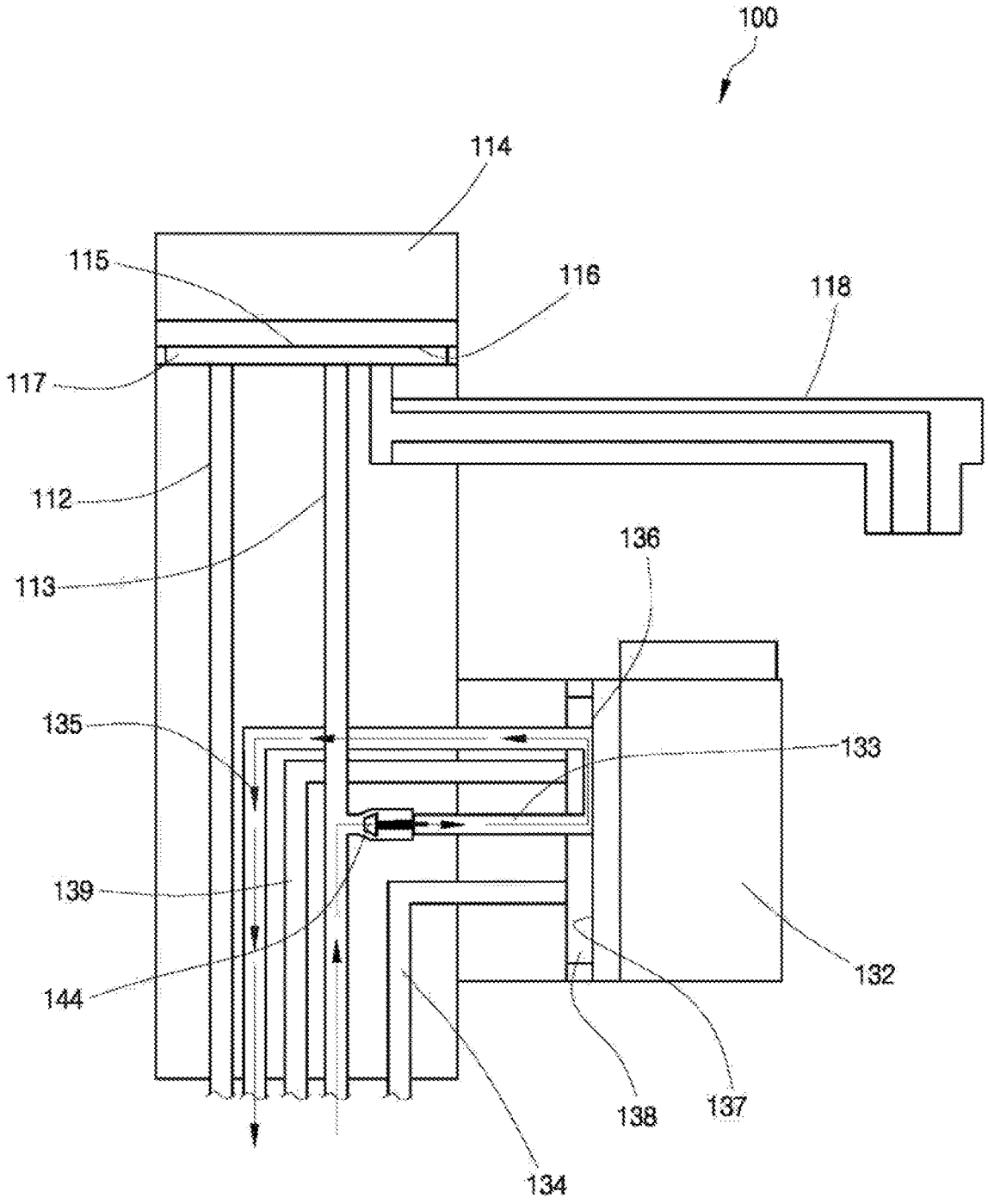
FIG. 4 is a use state diagram illustrating a state in which the washstand is lowered in a state in which the water faucet of the integrated height adjusting washstand device of FIG. 1 is stopped.
Figure 5:
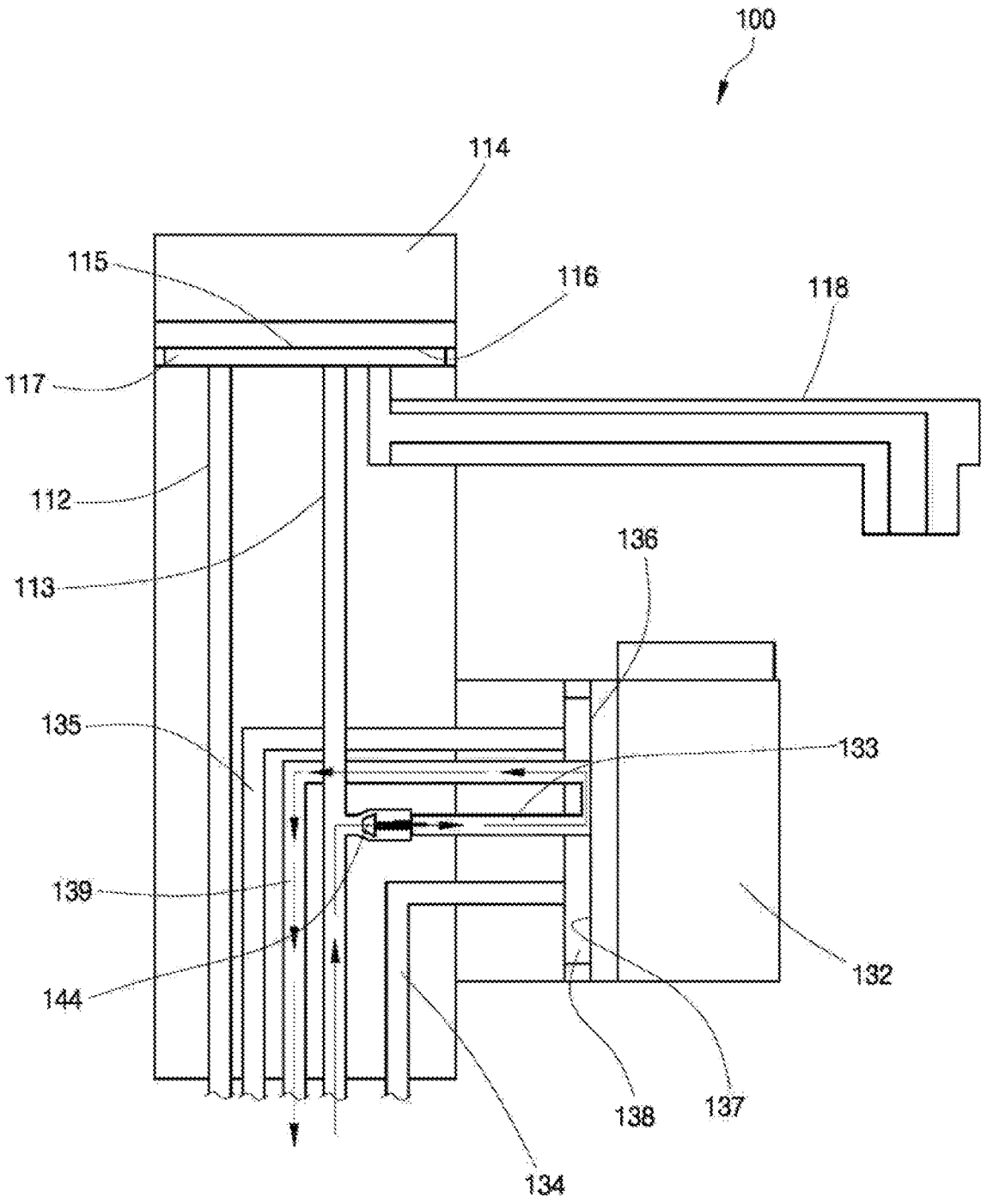
FIG. 5 is a use state diagram illustrating a state in which cold water is drained to an outside after finishing height adjustment of the washstand in a state in which the water faucet of the integrated height adjusting washstand device of FIG. 1 is stopped.
Figure 6:
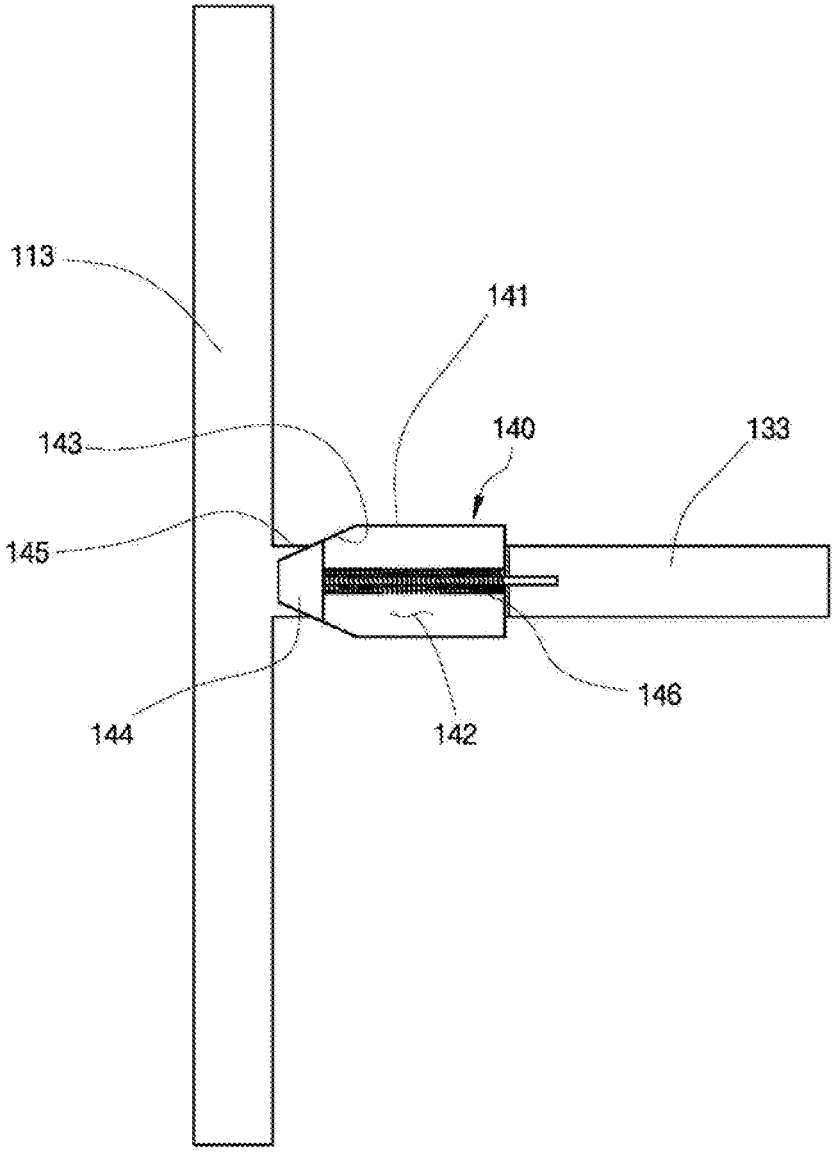
FIG. 6 is a partially cut-off enlarged configuration diagram illustrating a closed state of an operation shut-off part which is a main configuration of the integrated height adjusting washstand device of FIG. 1.
Figure 7:
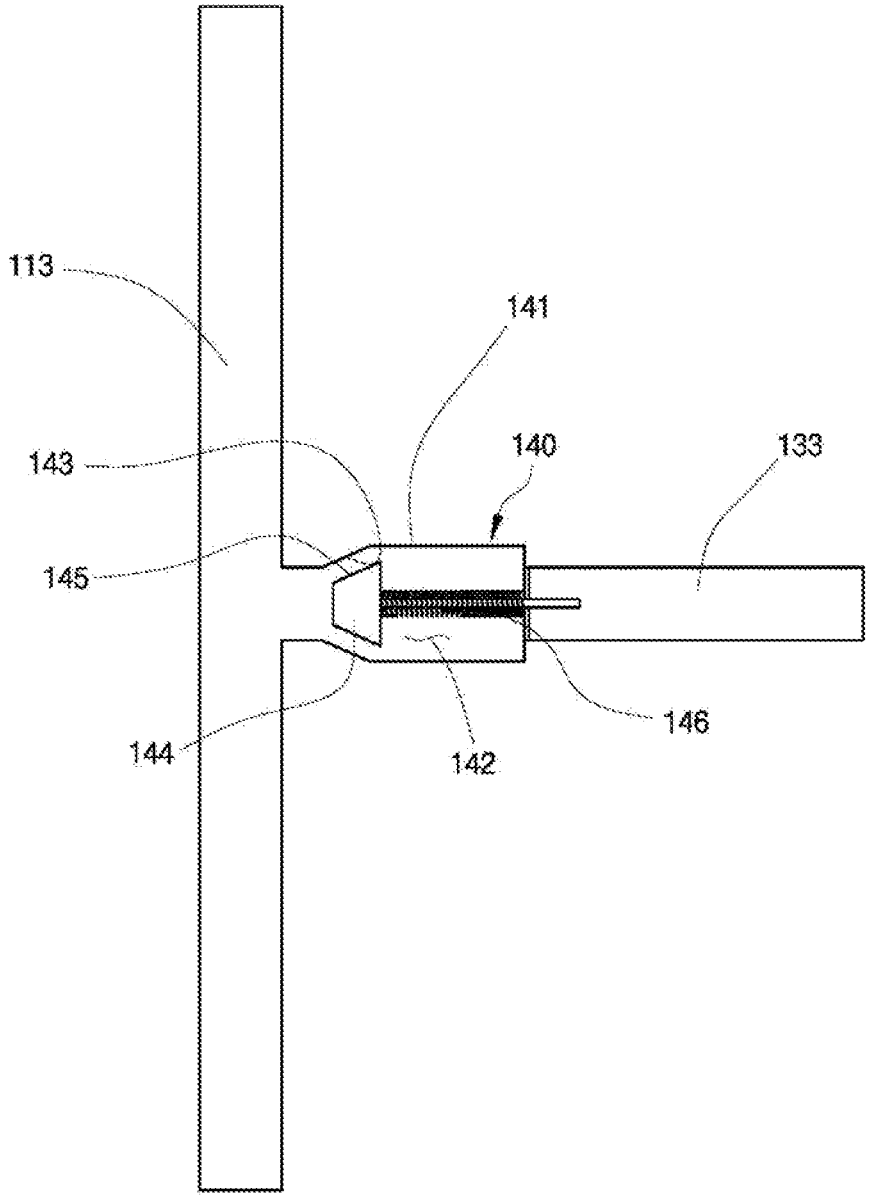
FIG. 7 is a partially cut-off enlarged configuration diagram illustrating an open state of the operation shut-off part which is the main configuration of the integrated height adjusting washstand device of FIG. 1.

FIG. 1 is a configuration diagram illustrating an integrated height adjusting washstand device according to an embodiment of the present invention, FIG. 2 is a use state diagram illustrating a state in which cold water is supplied by an operation of a water faucet of the integrated height adjusting washstand device of FIG. 1, FIG. 3 is a use state diagram illustrating a state in which a washstand is raised in a state in which the water faucet of the integrated height adjusting washstand device of FIG. 1 is stopped, FIG. 4 is a use state diagram illustrating a state in which the washstand is lowered in a state in which the water faucet of the integrated height adjusting washstand device of FIG. 1 is stopped, FIG. 5 is a use state diagram illustrating a state in which cold water is drained to an outside after finishing height adjustment of the washstand in a state in which the water faucet of the integrated height adjusting washstand device of FIG. 1 is stopped, FIG. 6 is a partially cut-off enlarged configuration diagram illustrating a closed state of an operation shut-off part which is a main configuration of the integrated height adjusting washstand device of FIG. 1, and FIG. 7 is a partially cut-off enlarged configuration diagram illustrating an open state of the operation shut-off part which is the main configuration of the integrated height adjusting washstand device of FIG. 1.

Referring to FIGS. 1 to 7, an integrated height adjusting washstand device 100 according to an embodiment of the present invention is a washing device that minimizes an installation space by integrally installing an adjusting means for adjusting a height of a washstand in a water faucet 110 located at an upper center of the washstand, improves operability as a user can operate together with the water faucet, and improves safety by preventing the washstand from being moved in use by presenting a locking effect in which the height is fixed by shutting off cold water supply when the wash faucet is used.

Such an integrated height adjusting washstand device 100 includes the water faucet 110, a height adjusting part 120, a height adjusting operation part 130, and an operation shut-off part 140.

The water faucet 110 is located at the upper center of the washstand and is provided to supply cold water and hot water while selectively adjusting a usage amount of by a user's operation.

Such a water faucet 110 includes a water faucet body 111, a hot water supply pipe 112, a cold water supply pipe 113, a water supply control lever 114, a water supply controller 115, a water supply control plate 117, and a water supply part 118.

The water faucet body 111 is fixedly disposed inward from the upper center of the washstand, has a portion in which the cold and hot water is supplied located therein, and is provided such that the height adjusting operation part 130 and the operation shut-off part 140 are installed at one side thereof.

The hot water supply pipe 112 is disposed inward at a lower portion of the water faucet body 111, and is provided in a pipe shape for supplying hot water supplied from the outside.

The cold water supply pipe 113 is disposed inward at the lower portion of the water faucet body 111, and is provided in a pipe shape for supplying cold water supplied from the outside.

The water supply control lever 114 is disposed at an upper portion of the water faucet body 111, and is provided so as to selectively control a water supply of cold water and hot water by the user's operation.

The water supply controller 115 is disposed inside the water faucet body 111, communicates with the water supply control lever 114 therein, and is provided to have a water supply control space 116 to which the cold water supply pipe 113 and the hot water supply pipe 112 are connected, respectively.

That is, the water supply controller 115 is installed at a position in which cold water and hot water are supplied in order to select the cold water and hot water and adjust a water supply amount with the water supply control lever 114, and is provided such that the water supply amount of the cold water and hot water may be selectively adjusted by the user's operation.

The water supply control plate 117 is disposed inside the water supply controller 115, and is installed to be interlocked with the water supply control lever 114, and is provided in a plate shape having a plurality of through-holes so as to control whether or not to supply the cold water supplied from the cold water supply pipe 113 and the hot water supplied from the hot water supply pipe 112 by the user's operation and a water supply amount.

That is, the water supply control plate 117 is provided in the plate shape in the water supply control space 116 to which the cold water supply pipe 113 and the hot water supply pipe 112 are connected such that cold water and hot water are supplied, and is provided so as to adjust a type and an amount of water supplied by changing a position of opening and closing in a direction of the water supply part 118 by an operation of the water supply control lever 114 according to a position of the through-holes.

Such a water supply control plate 117 is a general configuration for adjusting the water supply, and a detailed description thereof will be omitted.

The water supply part 118 is disposed to protrude from a front surface of the water faucet body 111, and is communicated with the water supply control space 116, and is provided so as to supply the cold and hot water controlled by an operation of the water supply control lever 114.

The height adjusting part 120 is disposed at a lower portion of the washstand, and is provided so as to adjust the height while receiving cold water and raising or lowering the washstand by the user's operation.

The height adjusting part 120 includes an adjusting cylinder 121, a lowering port 123, and a raising port 124.

The adjusting cylinder 121 is disposed at the lower portion of the washstand, and a piston 122 which is operated up and down by a fluid supplied from the lower portion of the washstand is fixedly installed to a ground from the inside, and is provided such that the washstand is moved vertically depending on a supply position of the height adjusting operation part 130.

The lowering port 123 is disposed at a lower portion of the adjusting cylinder 121, and when cold water is supplied by an operation of the height adjusting operation part 130, the cold water is supplied in a downward direction of the piston 122 in the adjusting cylinder 121, and the raising port 123 is provided to connect to the height adjusting operation part 130 so as to lower the washstand.

The raising port 124 is disposed at an upper portion of the adjusting cylinder 121, and when cold water is supplied by an operation of the height adjusting operation part 130, the cold water is supplied in an upward direction of the piston 122 in the adjusting cylinder 121, and the raising port 123 is provided to connect to the height adjusting operation part 130 so as to raise the washstand.

The height adjusting operation part 130 is disposed at one side of the water faucet 110, and is connected to the water faucet 110 and the height adjusting part 120, respectively, and operates so as to control the height by adjusting a supply amount and a direction of the cold water supplied to the height adjusting part 120 by the user's operation.

Such a height adjusting operation part 130 includes an operation body 131, an operation lever 132, a supply pipe 133, a raising operation pipe 134, a lowering operation pipe 135, an operation control part 136, an operation control plate 138, and a drain pipe 139.

The operation body 131 is disposed to protrude from one side surface of the water faucet body 111, and is installed so as to communicate with the cold water supply pipe 113 to which cold water is supplied.

The operation lever 132 is disposed at an upper portion of the operation body 131, and is operated so as to control a height of the washstand in accordance with a vertical operation of the adjusting cylinder 121 by the user's operation.

The supply pipe 133 is disposed inside the operation body 131, and is connect to the cold water supply pipe 113 to supply cold water for operating the adjusting cylinder 121, but is installed with the operation shut-off part 140 therein, and is provided so as to shut off the supply of cold water when cold water is supplied from the cold water supply pipe 113.

The raising operation pipe 135 is disposed inside the operation body 131, and is provided so as to connect the cold water supplied to the supply pipe 133 to the raising port 124 that is raised by the user's operation of the operation lever.

The lowering operation pipe 134 is disposed inside the operation body 131, and is provided so as to connect the cold water supplied to the supply pipe 133 to the lowering port 123 that is lowered by a user operation of the operation lever.

The operation control part 136 is disposed inside the operation body 131, and is provided so as to have an operation control space 137 connected to the supply pipe 133, the raising operation pipe 135, and the lowering operation pipe 134, respectively while communicating with the operation lever 132 therein.

That is, the operation control part 136 is connected to the raising operation pipe 135 and the lowering operation pipe 134, respectively at the raising port 124 and the lowering port 123 in the adjusting cylinder 121 for selection of the operation of raising or lowering the washstand by the operation lever 132 and is provided so as to control the operation of raising and lowering the washstand by selectively supplying the cold water supplied to the supply pipe 133 by the user's operation.

The operation control plate 138 is disposed inside the operation control part 136 and is installed in the operation control space 137 to be interlocked with the operation lever 132, and is provided in a plate shape having a plurality of through-holes for selectively controlling whether or not to supply the cold water supplied from the supply pipe 133 to the raising operation pipe 135 during the raising operation and to supply the cold water to the lowering operation pipe 134 during the lowering operation by the user's operation and an water supply amount.

The drain pipe 139 is disposed outward from one side of the operation control part 136, and connected to the operation control space 137, and is provided so as to drain the cold water supplied to the supply pipe 133 to the outside during the height adjusting operation.

The operation shut-off part 140 is installed at a supply position of the cold water supplied to the height adjusting operation part 130, and is provided so as to suppress the height adjusting operation by shutting off the cold water supplied to the height adjusting operation part 130 when the cold water in the water faucet 110 is used.

Such an operation shut-off part 140 includes a shut-off body 141, a shut-off valve part 144, and a valve elastic part 146.

The shut-off body 141 is installed in the supply pipe 133, and has a shut-off space 142 therein that is a space through which the cold water passes, and is formed with a shut-off inclined portion 143 inclined such that a cross-sectional area of a flow path is reduced to a connection side of the cold water supply pipe 113 in the shut-off space 142.

The shut-off valve part 144 is disposed inside the shut-off body 141, and is provided so as to open and close the flow path through which the cold water passes while moving inside the shut-off space 142, and is formed with a valve inclined portion 145 so as to have an inclination in contact with the shut-off inclined portion 143 in a direction of the cold water supply pipe.

The shut-off inclined portion 143 and the valve inclined portion 145 are provided with an inclination in which an area contacted when the shut-off body 141 is closed by the shut-off valve part 144 is enlarged, and the closing efficiency may be further improved.

The valve elastic part 146 is disposed inside the shut-off body 141, and is provided such that the shut-off valve part 144 is elastically supported in the shut-off body 141, and is provided in a spring shape that provides an elastic power in a state in which the shut-off space 142 is closed by an elastic force.

That is, the cold water is used as the water supply through the cold water supply pipe 113 and the water supply part 118 by operating the water supply control lever 114, and is used together in height adjustment while being supplied to the adjusting cylinder 121 through the supply pipe 133 by an operation of the operation lever 132.

Therefore, when cold water is supplied during height adjustment, smooth water supply is difficult, and an amount of cold water required for height adjustment is reduced, so that the height is not adjusted to the height desired by the user. When cold water is used, even when the height is adjusted, the height is not adjusted immediately due to a malfunction by the user, but the height is suddenly adjusted, and the washstand is moved in a state not expected by the user, and thus there was a problem that the user is injured.

Accordingly, the shut-off body 141 is installed at a position supplied to the supply pipe 133 through the cold water supply pipe 113 so that the shut-off valve part 144 shuts off the shut-off space 142 by an elastic force of the valve elastic part 146 when the user uses cold water, and the cold water is prevented from being supplied to the height adjusting operation part 130 and the height adjustment is suppressed, and thus it is possible to prevent a deterioration of safety due to a malfunction.

In addition, when the use of cold water is finished, the shut-off space 142 is opened while the shut-off valve part 144 is moved by a pressure of the cold water, and thus the user may adjust the height by an operation of the operation lever.

The above descriptions are merely illustrative the technical spirit of the present invention. It will be understood by those skilled in the art that various modifications and variations may be made without departing from the essential features of the invention.

Therefore, the embodiments disclosed in the present invention are not intended to limit the technical spirit of the present invention but to describe the present invention, and the scope of the technical spirit of the present invention is not limited by such embodiments.

The scope of the present invention should be construed according to the following claims, and all technical spirits that fall within the equivalent scope thereof should be construed as being included in the scope of the present invention.

The invention claimed is:

1. An integrated height adjusting washstand device, the device comprising:

a water faucet located at an upper center of a washstand and supplying cold water and hot water while selectively adjusting a usage amount thereof by a user's operation;

a height adjusting part disposed at a lower portion of the washstand, comprising an adjusting cylinder, a lowering part, and a raising port, and adjusting a height while receiving the cold water from the water faucet and raising or lowering the washstand by the user's operation;

a height adjusting operation part disposed at one side surface of the water faucet and connected to the water faucet and the height adjusting part, respectively, comprising an operation body, an operation lever, a supply pipe, a raising operation pipe, a lowering operation pipe, an operation control part, an operation control plate, and a drain pipe, and operating so as to control the height by adjusting a supply amount and a direction of the cold water supplied from the water faucet to the height adjusting part by the user's operation; and an operation shut-off part installed at a supply position of the cold water supplied to the height adjusting operation part, and provided so as to suppress the height adjusting operation by shutting off the cold water supplied to the height adjusting operation part when the cold water in the water faucet is used, wherein when the cold water is supplied by an operation of the water faucet, the height is fixed by shutting off an operation of the height adjusting part by an operation of the operation shut-off part in order to prevent the height adjust from malfunctioning due to reduction of the amount of cold water supplied to the height adjusting part, and the operation shut-off part comprises:

a shut-off body installed in the supply pipe, and having a shut-off space therein that is a space through which the cold water passes, and formed with a shut-off inclined portion inclined such that a cross-sectional area of a flow path is reduced to a connection side of the cold water supply pipe in the shut-off space;

a shut-off valve part disposed inside the shut-off body, provided so as to open and close the flow path through which the cold water of the water faucet passes while moving inside the shut-off space, and formed with a valve inclined portion having a slope in contact with the shut-off inclined portion in a direction of the water faucet; and a valve elastic part disposed inside the shut-off body, directly connected to the shut-off valve part, provided such that the shut-off valve part is elastically supported in the shut-off body, and provided in a spring shape that provides an elastic power in a state in which the shut-off space is able to be closed by an elastic force.

2. The device of claim 1, wherein the water faucet comprises:

a water faucet body fixedly disposed inward from the upper center of the washstand, having a portion in which cold and hot water is supplied located therein, and provided such that the height adjusting operation part and the operation shut-off part are installed at one side surface thereof;

a hot water supply pipe disposed inward at a lower portion of the water faucet body, and provided in a pipe shape for supplying hot water supplied from an outside;

a cold water supply pipe disposed inward at the lower portion of the water faucet body, and provided in a pipe shape for supplying cold water supplied from the outside;

a water supply control lever disposed at an upper portion of the water faucet body, and selectively controlling a water supply of cold water and hot water by the user's operation;

a water supply controller disposed inside the water faucet body, communicating with the water supply control lever therein and having a water supply control space to which the cold water supply pipe and the hot water supply pipe are connected, respectively;

a water supply control plate disposed inside the water supply controller, installed to be interlocked with the water supply control lever, and provided in a plate shape having a plurality of through-holes so as to control whether or not to supply the cold water supplied from the cold water supply pipe and the hot water supplied from the hot water supply pipe by the user's operation and a water supply amount; and a water supply part disposed to protrude from a front surface of the water faucet body, communicated with the water supply control space, and supplying the cold and hot water controlled by an operation of the water supply control lever.

3. The device of claim 1, wherein in the height adjusting part, the adjusting cylinder is disposed at the lower portion of the washstand, wherein a piston which is operated up and down by a fluid supplied from the lower portion of the washstand is fixedly installed to a ground from the inside so that the washstand is moved vertically depending on a supply position of the height adjusting operation part, the lowering port is disposed at a lower portion of the adjusting cylinder, and when cold water is supplied by an operation of the height adjusting operation part, the cold water is supplied in a downward direction of the piston in the adjusting cylinder so that the cold water is supplied to a lower surface of the piston and the lowering port is provided to connect to the height adjusting operation part so as to lower the washstand, and the raising port is disposed at an upper portion of the adjusting cylinder, and when cold water is supplied by an operation of the height adjusting operation part, the cold water is supplied in an upward direction of the piston in the adjusting cylinder so that the cold water is supplied to an upper surface of the piston, and the raising port is provided to connect to the height adjusting operation part so as to raise the washstand.

4. The device of claim 1, wherein M the height adjusting operation part, the operation body is disposed to protrude from one side surface of the water faucet, and installed so as to communicate with a position to which the cold water of the water faucet is supplied, the operation lever is disposed at an upper portion of the operation body, and selectively controls a vertical operation of the height adjusting part by the user's operation, the supply pipe is disposed inside the operation body, connected to the cold water supply portion of the water faucet to supply cold water for operating the height adjusting part, but installed with the operation shut-off part therein to shut off the supply of the cold water when the cold water is supplied from the water faucet, the raising operation pipe is disposed inside the operation body, and connects the cold water supplied to the supply pipe to a position in which the height adjusting part is raised by the user's operation of the operation lever, the lowering operation pipe is disposed inside the operation body and connects the cold water supplied to the supply pipe to a position in which the height adjusting part is lowered by the user's operation of the operation lever, the operation control part is disposed inside the operation body and has an operation control space connected to the supply pipe, the raising operation pipe, and the lowering operation pipe, respectively while communicating with the operation lever therein, the operation control plate is disposed inside the operation control part, installed in the operation control space to be interlocked with the operation lever, and provided in a plate shape having a plurality of through-holes for selectively controlling whether or not to supply the cold water supplied from the supply pipe to the raising operation pipe during a raising operation and to supply the cold water to the lowering operation pipe during a lowering operation by the user's operation and an water supply amount, and the drain pipe is disposed outward from one side of the operation control part, and connected to the operation control space to drain the cold water supplied to the supply pipe to the outside when a height adjust operation is stopped.

* * * * *